United States Patent [19]

Youngblood et al.

[11] Patent Number: 5,011,117

[45] Date of Patent: Apr. 30, 1991

[54] POST PULLER

[76] Inventors: Dale Youngblood, P.O. Box 245, La Sal, Utah 84530; Harry L. Hutchins, 2780 Desert Rd., Moab, Utah 84532

[21] Appl. No.: 509,728

[22] Filed: Apr. 16, 1990

[51] Int. Cl.[5] ..... B66F 3/06; E21B 10/02

[52] U.S. Cl. ..... 254/30

[58] Field of Search ..... 254/29 R, 30, 31, 132; 294/82.1–82.13

[56] References Cited

U.S. PATENT DOCUMENTS 733,989 7/1903 Morris ..... 294/82.13
1,304,669 5/1919 Engstrom ..... 254/31
3,762,687 10/1973 DeRome .
4,161,310 7/1979 Parker .

FOREIGN PATENT DOCUMENTS 136784 3/1950 Australia ..... 254/132

*Primary Examiner*—Robert C. Watson

[57] ABSTRACT

A post puller apparatus that includes a single thickened plate having a hole therethrough configured to the cross sectional shape of a post that needs to be pulled up out of the ground. The plate assumes a tilted position on the post. A chain is attached to the upper end of the plate for connection with a hoisting apparatus. Operation of the hoisting apparatus causes the tilted plate to be clamped against the post for drawing the post out of the ground.

1 Claim, 1 Drawing Sheet

POST PULLER

BACKGROUND AND SUMMARY OF THE INVENTION

This invention relates to puller apparatus for removing (lifting) metal posts from the ground. The invention is especially concerned with the expeditious removal of metal fence posts from anchored positions extending into the ground.

U.S. Pat. No. 3,762,687 to E. DeRome shows a post puller apparatus that comprises two metal plates having cross-shaped holes therethrough configured to the cross-sectional shape of a metal post. The two plates can be thereby slipped downwardly on a metal fence post and then tilted at acute angles to the post axis, such that edge areas of the holes in the plates can grip side surfaces of the post. The two plates are individually attached to opposite ends of a chain that is attachable to a hook extending downwardly from a hoisting apparatus. When the hook is drawn vertically upwardly the two tilted plates act as clamps to grip the post tightly for pulling the post out of the ground.

The apparatus of U.S. Pat. No. 3,762,687 can be operated successfully. However, the patented apparatus is believed to have some deficiencies. For example, the holes in the two plates are mirror images of one another, but they are not symmetrical. This means that the plates must be installed onto a post in a certain order, and with specific surfaces of each plate facing upwardly; it is possible to install the plates incorrectly if the person fails to follow a specific procedure.

Also, with the apparatus of U.S. Pat. No. 3,762,687 the plates are susceptible to falling in an unregulated fashion downwardly along the post. It may be difficult to lower and hold the two clamping plates at specific locations on the post. If the hoisting apparatus has a limited stroke distance it may be desirable to position the clamping plates at specific locations on the post such that the stroke distance of the hoisting apparatus can be fully utilized for lifting purposes (not merely taking up slack in the chain). The patented apparatus is not believed suited to an easy and simultaneous manipulation of the clamping plates to specific locations on the post.

The apparatus of U.S. Pat. No. 3,762,687 apparently requires that the two clamping plates be in simultaneous engagement with the post and with each other before initiation of a pulling force by the hoisting apparatus. This would seem to dictate a two-man operation, i.e. one man to hold the two plates in position, and a second man to operate the hoisting apparatus. It would be desirable to have an apparatus that could be operated by one man.

The present invention contemplates a post puller apparatus that utilizes only one clamping plate, as opposed to the two clamping plates required in the apparatus of U.S. Pat. No. 3,762,687. The single clamping plate is designed so that when it is moved downward on a post it will stay in any given position to which it is moved; this adapts the apparatus for one-man operation. The lifter chain associated with the single clamping has a series of enlarged lifter rings spaced therealong, such that the hoist apparatus can be operatively engaged with any one of the lifter rings. This feature gives the apparatus some versatility as regards the type of hoisting apparatus that can be used; the hoisting apparatus can have its chain-attachment hook located at different elevations without rendering the system inoperable.

THE DRAWINGS

DESCRIPTION OF A PREFERRED EMBODIMENT OF THE INVENTION

Figure 1:
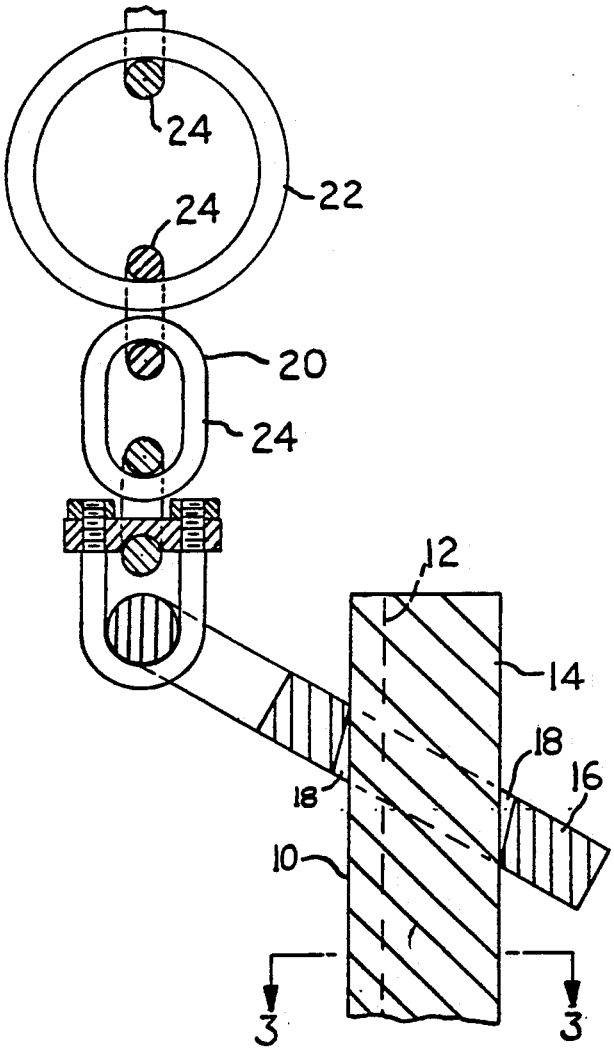
FIG. 1 is a sectional view taken through a puller apparatus embodying the invention.
Figure 2:
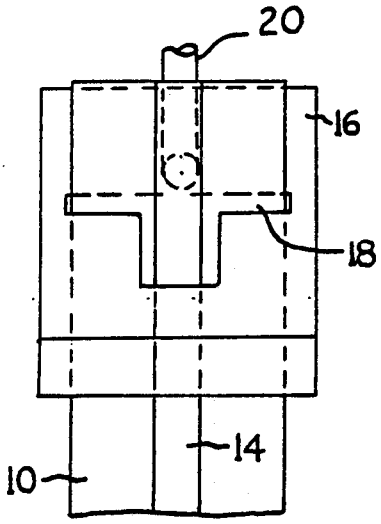
FIG. 2 is a right elevations view of the FIG. 1 apparatus.
Figure 3:
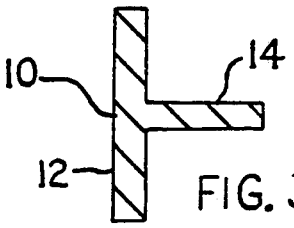
FIG. 3 is a sectional view on line 3—3 in FIG. 1.

The drawings show a post puller apparatus adapted to have a gripping (clamping) fit on an upstanding metal post 10. The post may be a fence post having lower end section (not shown) embedded in the ground. The puller apparatus is designed to lift the fence post out of the ground. The illustrated post has a T cross-section that includes a main wall section 12 and a flange 14 extending right angularly from a midpoint along the main wall section.

The puller apparatus comprises a single thickened plate 16 having a T-shaped hole 18 extending therethrough. Hole 18 has the same general cross-sectional configuration as post 10 except that the hole is somewhat larger to provide an edge clearance between the post and hole when plate 16 is being moved downwardly along the post.

A lifter chain 20 is suitably attached to plate 16. This chain is somewhat unusual in that it includes two or more enlarged rings 22 at spaced points along its length. Only a portion of the chain is shown in FIG. 1. Typically the chain will have a total length of about six feet. A few inches from its attached end the chain will have an enlarged lifter ring 22, as shown in FIG. 1. At about the three foot mark along the chain there will be another lifter ring similar in size to ring 22 (FIG. 1). At the remote (free) end of the chain there may be another lifter ring. Each lifter ring is preferably a circular ring having a diameter of about three inches. Such a diameter is sufficient to enable the ring to fit onto a conventional hook (not shown) constituting part of a conventional hoisting apparatus.

The hoisting apparatus can be any suitable apparatus, e.g. a hand-man jack, or a winch system (reel-cable apparatus) installed on a tractor, or a hook structure installed on a front-end loader. The purpose in providing three (or more) lifter rings in the lifter chain is to permit the illustrated apparatus to be used with different hoist systems in which the lifter hook is located different distances above ground level or in which the lifter hook has a different stroke distance.

As shown in FIG. 1, the lifter chain is conventional except for the presence of lifter rings 22. The chain includes chain sections comprised of a plurality of endless egg-shaped chain links 24 interlocked together in conventional fashion.

The puller apparatus preferably is constructed so that when thickened plate 16 is lowered to a specific point on post 10 and then released, the plate will remain in position on the post, i.e. the plate will not inherently drop down along the post to the ground or to a new location. To facilitate the desired action plate 16 has hole 18 oriented so that the edges of the hole are acutely angled to the plane of the plate. The plate is lowered onto the post with the plate in a tilted condition, as shown in FIG. 1. When the plate is released the plate maintains its position due to natural gravitational forces exerted on the plate.

The puller apparatus can be operated by a single person without great difficulty. Thus, the thickened plate 16 is lowered to an appropriate point along the post. The lifter chain is then attached to the hook on the hoisting apparatus (via one of the lifter rings 22). Then the hoisting apparatus is operated to pull post 10 out of the ground; plate 16 acts as a wedge or clamp against the engaged areas of the post.

The apparatus will operate with plate 16 located at any of several different locations along the length of the post. The plate 16 location can be selected in relation to an appropriate selection of a lifter ring 22, so as to adapt the puller apparatus to a variety of different hoisting systems, i.e. different hook elevations and different stroke distances.

The illustrated apparatus is a relatively low cost construction that is nevertheless well suited for its intended purpose. The drawings show an apparatus designed to be used with metal posts having T cross-sections. It will be appreciated that the apparatus can be designed for use with posts having other cross-sections (by reconfiguring hole 18).

We claim:

1. A metal post puller apparatus, wherein the post has a T cross-section: said apparatus comprising a single thickened plate having a post-encircling hole therethrough; said hole having the same T cross-sectional shape as the post but with a slight edge clearance therearound to facilitate downward motion of the plate on the post; said hole having edges thereof acutely angled to the plane of the thickened plate whereby the plate assumes a tilted condition on the post; and a lifter chain attached to said plate; said lifter chain comprising a plural number of separate spaced chain sections, and enlarged circular rings interconnecting the chain sections; each chain section comprising a plurality of endless egg-shaped chain links interlocked together; each enlarged circular ring having a diameter substantially larger than the length of each chain link, whereby each circular ring can serve as a device for attaching the chain to a lifter mechanism.

* * * * *